US011980271B2

(12) United States Patent
Siu

(10) Patent No.: US 11,980,271 B2
(45) Date of Patent: May 14, 2024

(54) HAIR DRYER WITH ION EMITTER

(71) Applicant: CONAIR CORPORATION, Stamford, CT (US)

(72) Inventor: Kwan Shing Benny Siu, Tseung Kwan O (HK)

(73) Assignee: Conair LLC, Stamford, CT (US)

( * ) Notice: Subject to any disclaimer, the term of this patent is extended or adjusted under 35 U.S.C. 154(b) by 668 days.

(21) Appl. No.: 16/996,035

(22) Filed: Aug. 18, 2020

(65) Prior Publication Data

US 2022/0053905 A1 Feb. 24, 2022

(51) Int. Cl.
*A45D 20/12* (2006.01)
*A45D 20/10* (2006.01)

(52) U.S. Cl.
CPC ..... *A45D 20/12* (2013.01); *A45D 20/10* (2013.01); *A45D 2200/202* (2013.01)

(58) Field of Classification Search
CPC .. A45D 20/12; A45D 20/10; A45D 2200/202; A45D 2200/20; A45D 20/00; A45D 20/34; A45D 20/122
See application file for complete search history.

(56) References Cited

U.S. PATENT DOCUMENTS 5,805,406 A 9/1998 Malland
7,644,511 B2 1/2010 Ishikawa et al.
2004/0172847 A1 9/2004 Saida et al.
2006/0076032 A1 4/2006 Fung
2014/0290087 A1 10/2014 Weatherly

FOREIGN PATENT DOCUMENTS

CN 105795675 A * 7/2016
CN 105919265 A * 9/2016
EP 2 433 519 A1 3/2012
JP 2001037530 A * 2/2001
(Continued)

OTHER PUBLICATIONS

English translation CN-105919265-A, Sep. 2016 (Year: 2016).*
(Continued)

*Primary Examiner* — Jessica Yuen
(74) *Attorney, Agent, or Firm* — Ruggiero McAllister & McMahon LLC

(57) ABSTRACT

A hair dryer includes a housing having a main air inlet, a main air outlet and a main interior volume between the main air inlet and the main air outlet. The housing has an auxiliary air inlet, an auxiliary air outlet, and an auxiliary interior volume between the auxiliary air inlet and the auxiliary air outlet. The auxiliary air inlet, the auxiliary air outlet and the auxiliary interior volume each are outside of the main interior volume so that the auxiliary air inlet and the auxiliary air outlet are not in communication with the main air inlet and the main air outlet. A first pair of ion emitters are in the main interior volume. A second pair of ion emitters are in the auxiliary interior volume. A fan is upstream of the first pair of ion emitters in the main interior volume, and selectively generates a main airflow through the housing from the main air inlet to the main air outlet. A heater is in the main interior downstream of the fan and upstream of the main air outlet relative to the main airflow.

17 Claims, 5 Drawing Sheets

(56) References Cited

FOREIGN PATENT DOCUMENTS

| | | | | |
|---|---|---|---|---|
| JP | 2010193947 A | * | 9/2010 | |
| WO | WO-2016181675 A1 | * | 11/2016 | ..... A45D 20/12 |

OTHER PUBLICATIONS

English translation, JP-2001037530-A, Feb. 2001 (Year: 2001).*
English translation, CN-105795675-A, Jul. 2016 (Year: 2016).*
English translation, JP-2010193947-A, Sep. 2010 (Year: 2010).*
English translation, WO-2016181675-A1, Nov. 2016 (Year: 2016).*
International Search Report dated Nov. 16, 2021 from International Patent Application No. PCT/US2021/045349, 3 pages.
Written Opinion dated Nov. 16, 2021 from International Patent Application No. PCT/US2021/045349, 4 pages.

* cited by examiner

HAIR DRYER WITH ION EMITTER

BACKGROUND OF THE DISCLOSURE

1. Field of the Disclosure

The present disclosure relates to devices for drying hair using ions. The present disclosure further relates to a hair dryer with an ion emitter.

2. Description of the Related Art

Delivering ions or ionically charged molecules to a person's hair provides benefits including the removal of undesirable static charge that naturally occurs in hair. For example, U.S. Pat. No. 7,644,511 filed Jun. 27, 2007 ("Ishikawa") provides a hair dryer that discharges ions. In particular, Ishikawa provides a hair dryer that has a main body with an inlet port and a discharge port, an air flow path with the air flow path extending from the inlet port to the discharge port and a bypass flow path with the bypass flow path branching off from the air flow path and leading to an ion emission port. Further, Ishikawa requires an auxiliary air inlet associated with the ion emission port. This structure results in the auxiliary air inlet and the ion emission port undesirably being in communication with the hair dryer's main air inlet and outlet.

Accordingly, there is a need to address this disadvantage of currently available systems.

SUMMARY OF THE DISCLOSURE

A hair dryer that has two pairs of positive and negative ion emitters is provided. A first pair of ion emitters is located in a main barrel of the hair dryer that has a main air inlet and a main air outlet. The second pair of ion emitters is installed inside a protruded area located on top of the main barrel that has an auxiliary air inlet and an auxiliary air outlet. The auxiliary air inlet and the auxiliary air outlet are not in communication with the main air inlet or the main air outlet.

A hair dryer is also provided that includes a housing having a main air inlet, a main air outlet and a main interior volume between the main air inlet and the main air outlet. The housing has an auxiliary air inlet, an auxiliary air outlet, and an auxiliary interior volume defined between the auxiliary air inlet and the auxiliary air outlet. The auxiliary air inlet, the auxiliary air outlet and the auxiliary interior volume each are outside of the main interior volume so that the auxiliary air inlet and the auxiliary air outlet are not in communication with the main air inlet and the main air outlet. A first pair of ion emitters are in the main interior volume. A second pair of ion emitters are in the auxiliary interior volume.

A fan is located in the main interior volume upstream of the first pair of ion emitters, and selectively generates a main airflow through the housing from the main air inlet to the main air outlet. A heater is in the main interior volume downstream of the fan and upstream of the main air outlet relative to the main airflow.

The housing can have an interior wall and an exterior wall. The interior wall can surround the main interior volume. The auxiliary interior volume can be located between the exterior wall and the interior wall so that the interior wall separates the auxiliary interior volume from the main interior volume. The interior wall can form the main air inlet and the main air outlet. The exterior wall can have an inlet hole forming the auxiliary air inlet. The exterior wall can have an outlet hole forming the auxiliary air outlet. The interior wall and the exterior wall can contact each other adjacent the auxiliary air outlet. Also, the exterior wall and interior wall can contact each other adjacent the main air inlet to form the auxiliary interior volume. The first pair of ion emitters can have a positive ion emitter that generates positive ions and a negative ion emitter that generates negative ions. Likewise, the second pair of ion emitters can have a positive ion emitter that generates positive ions and a negative ion emitter that generates negative ions. The main airflow moves positive and negative ions from the first pair of ion emitters out of the main air outlet. The auxiliary interior volume allows air to pass through the auxiliary air inlet forming an auxiliary air flow that passes through the auxiliary interior volume and out of the auxiliary air outlet so that positive and negative ions from the second pair of ion emitters are brought out of the auxiliary air outlet.

The main airflow can have a speed at the main air outlet that is higher than a surrounding area. Thus, some air will be drawn along a direction of the main airflow through the auxiliary air inlet to form the auxiliary air flow. This auxiliary air flow can bring or urge forward the positive and negative ions that are emitted from the auxiliary interior volume.

The housing can have a main barrel and a connector portion that is connected to a handle. The handle can be foldable relative to the housing. The handle can have a handle body forming an extension on one end, and can have an opening through the extension to connect the handle to the housing by a hinge connection. The hinge connection can be a pin that passes through the opening of the handle and through the connector portion of the housing so that the housing and the handle are rotatable relative to each other.

The above and other objects, features, and advantages of the present disclosure will be apparent and understood by those skilled in the art from the following detailed description, drawings, and accompanying claims. As shown throughout the drawings, like reference numerals designate like or corresponding parts.

BRIEF DESCRIPTION OF THE DRAWINGS

The present disclosure will be more completely understood in consideration of the following detailed description in connection with the accompanying drawings, in which.

DETAILED DESCRIPTION OF THE DISCLOSURE

Figure 1:
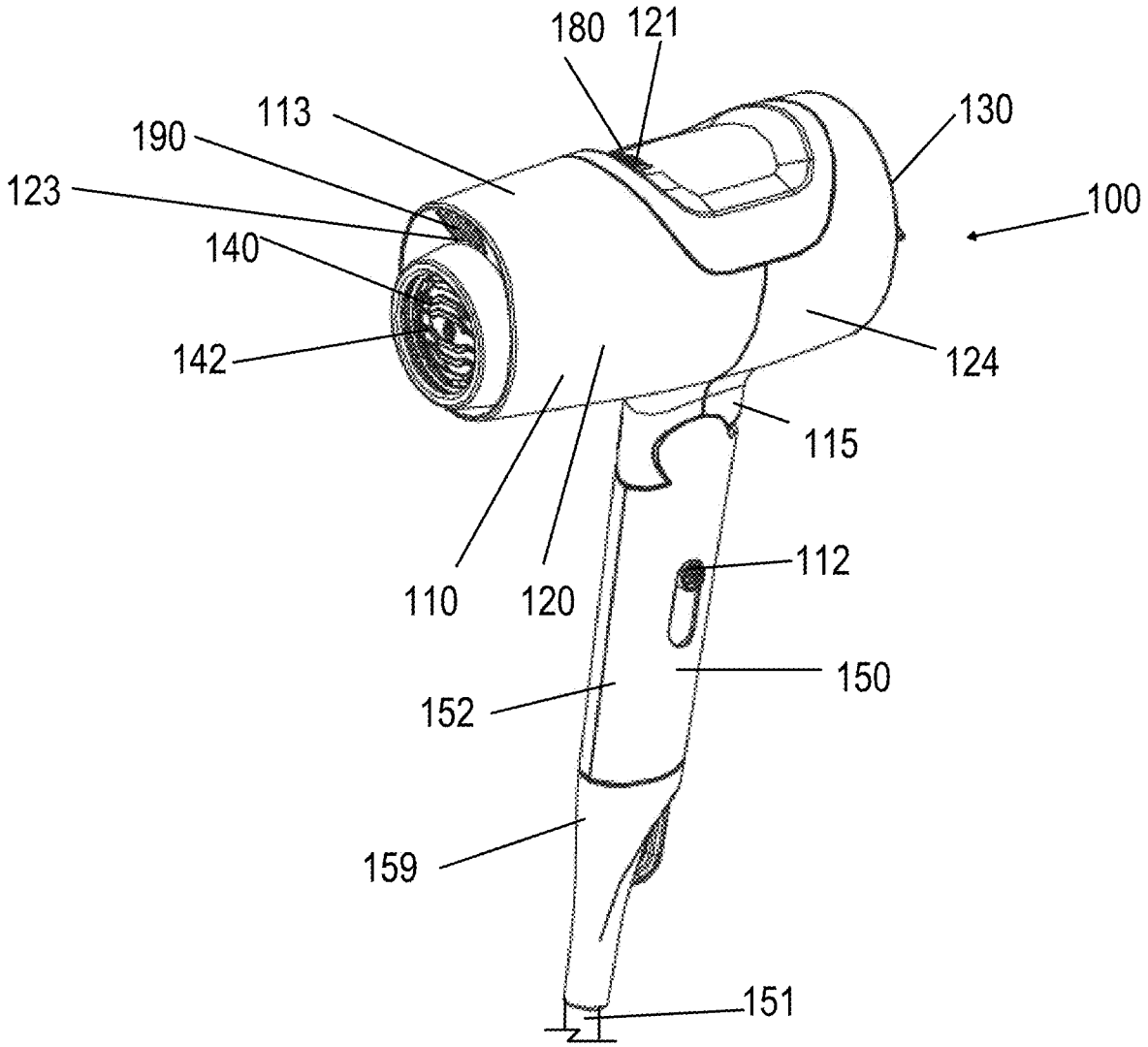
FIG. 1 is a top, front perspective view of a hair dryer having an ion emitter of the present disclosure.
Figure 2:
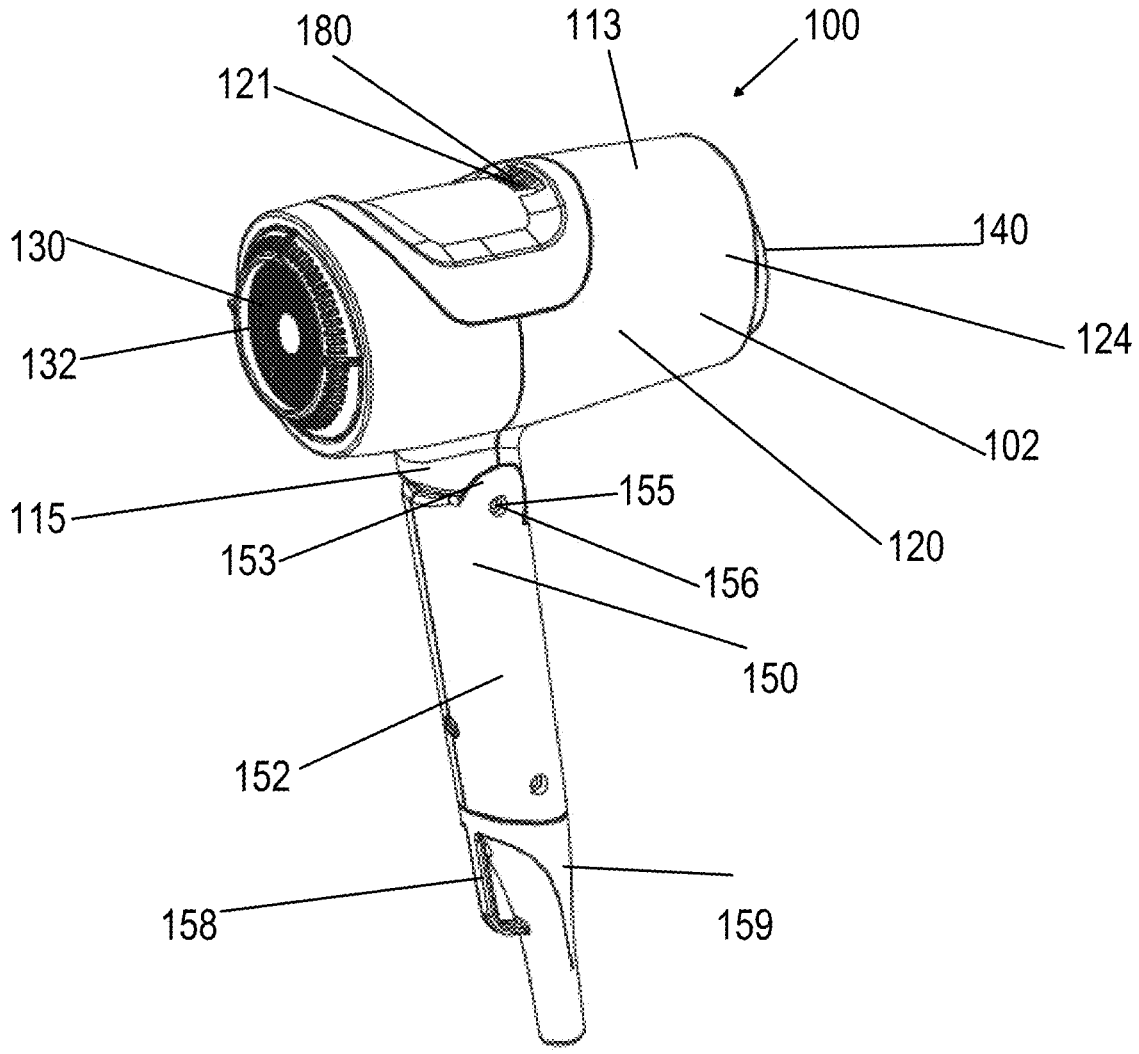
FIG. 2 is a top, rear perspective view of the hair dryer of FIG. 1.

Referring to FIGS. 1 and 2, there is provided a hair dryer generally represented by reference numeral 100. Hair dryer 100 has a housing 110 that includes a main barrel 120, main air inlet 130 and main air outlet 140, and a connector portion 115.

Figure 3:
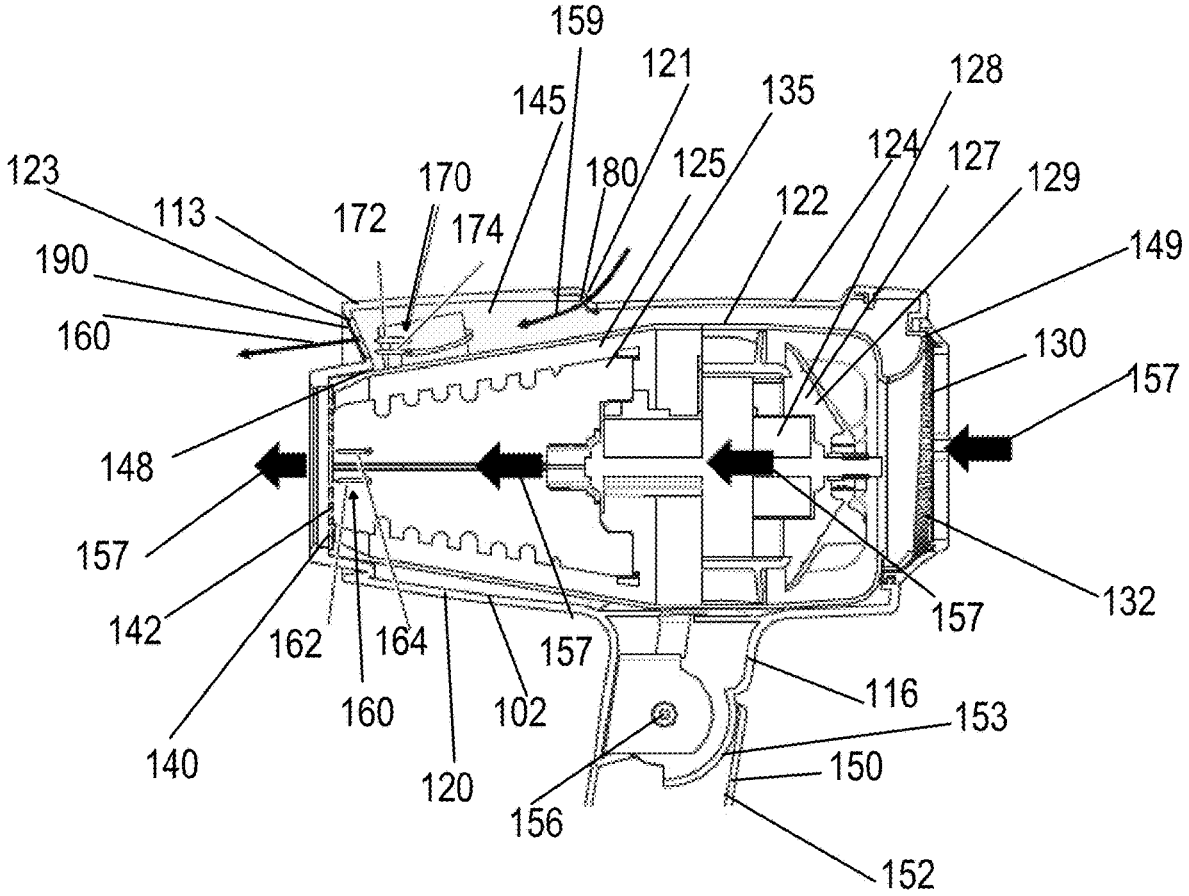
FIG. 3 is a partial side cross-sectional view of the hair dryer of FIG. 1 schematically showing direction of two airflows.

Housing 110 houses two pairs of positive and negative ion emitters. As shown in FIG. 3, a first pair of ion emitters 160 is located in main barrel 120. A second pair of ion emitters 170 is located inside a protruded area 113 located on top of main barrel 120.

Protruded area 113 has an auxiliary air inlet 180 and an auxiliary air outlet 190.

Auxiliary air inlet 180 and auxiliary air outlet 190 are not in communication with main air inlet 130 and main air outlet 140. Nonetheless, all the benefits of discharging positive and negative ions from second pair of ion emitters 170 during operation of hair dryer 100 is still provided.

Referring again to FIGS. 1 and 2, main barrel 120 has an exterior wall 124. Main air inlet 130 is covered by an inlet grille 132, as shown in FIG. 2. Main air outlet 140 is covered by an outlet grille 142, as shown in FIG. 1. Exterior wall 124 has inlet holes 121 forming auxiliary air inlet 180 and outlet holes 123 forming auxiliary air outlet 190. Connector portion 115 connects housing 110 to a handle 150.

Referring to FIG. 2, handle 150 has a handle body 152 that forms an extension 153 at a first end. Extension 153 and handle body 152 have an opening 155. Handle 150 is connected to housing 110 by a hinge connection. The hinge connection has a pin 156 that passes through opening 155 of handle 150 and through connector portion 115 of housing 110 so that main barrel 120 and handle 150 are rotatable relative to each other. Handle 150 is connected to a cord sleeve 159 at a second end opposite extension 154. Cord sleeve 159 surrounds a power cord 151, and shown in FIG. 1, and has a loop 158. Handle body 152 has a power button 112, as shown in FIG. 1. Preferably, housing 110 and handle 150 are plastic or metal.

Referring to FIG. 3, housing 110 has an interior wall 122 and exterior wall 124. Interior wall 122 surrounds a main interior volume 125. Interior wall 122 forms main air inlet 130 and main air outlet 140. A fan 127 is positioned in main interior volume 125 downstream of inlet grille 132 relative to a main airflow generated by operation of fan 127. Fan 127 has motor 128 to rotate fan blades 129. Hair dryer 100 has a heater 135 in main interior volume 125 downstream of fan 127 and upstream of outlet grille 142 relative to the main airflow. Heater 135, for example, is a mica heater. First pair of ion emitters 160 are downstream of fan 127 and upstream of outlet grille 142 relative to the main airflow. A portion or all of first pair of ion emitters 160 is inside of heater 135 adjacent outlet grille 142. First pair of ion emitters 160 has a positive ion emitter 162 and a negative ion emitter 164.

Still referring to FIG. 3, protruded area 113 is formed between interior wall 122 and exterior wall 124. Alternatively, protruded area 113 can be formed separately and then connected to housing 110. Interior wall 122 and exterior wall 124 form auxiliary interior volume 145 in the protruding area 113.

Interior wall 122 separates auxiliary interior volume 145 from main interior volume 125. Interior wall 122 and exterior wall 124 contact each other adjacent auxiliary air outlet 190 at a downstream location 148 and interior wall 122 and exterior wall 124 contact each other adjacent main air inlet 130 at an upstream location 149 to form auxiliary interior volume 145. Second pair of ion emitters 170 is in auxiliary interior volume 145.

Second pair of ion emitters 170 has a positive ion emitter 172 and a negative ion emitter 174.

Auxiliary air inlet 180, auxiliary air outlet 190 and auxiliary interior volume 145 each are outside of a main interior volume 125, so that auxiliary air inlet 180 and auxiliary air outlet 190 are not in communication with main air inlet 130 and main air outlet 140 of hair dryer 100.

During operation, power cord 151 is connected to a power source such as an electrical outlet supplying power to hair dryer 100. A user selectively turns hair dryer 100 on and off by moving power button 112 toward and away from housing 110 between an on position of power button 112 that is shown in FIG. 1 and an off position of power button 112 that is closer to cord sleeve 159. When the user turns hair dryer 100 on by moving power button 112 to the on position shown in FIG. 1, electrical current is conducted from the power supply through power cord 151 to heater 135, motor 128, first pair of ion emitters 160 and second pair of ion emitters 170. Heater 135 increases in temperature to a temperature above ambient temperature. Motor 128 rotates fan blades 129 generating the main airflow, as shown by arrows 157 in FIG. 3, that flows in from main air inlet 130 through main interior volume 125 and out of main air outlet 140. First pair of ion emitters 160 has positive ion emitter 162 that generates positive ions and negative ion emitter 164 that generates negative ions. Second pair of ion emitters 170 has positive ion emitter 172 that generates positive ions and negative ion emitter 174 that generates negative ions.

The main airflow, as shown by arrows 157, brings positive and negative ions from first pair of ion emitters 160 out of main air outlet 140. Protruded area 113 allows air to pass through inlet holes or openings 121 forming an auxiliary air flow, as shown by arrows 159, that passes into auxiliary air inlet 180 and through auxiliary interior volume 145 passing out of outlet openings 123 of auxiliary air outlet 190 bringing positive and negative ions from second pair of ion emitters 170 out of auxiliary air outlet 190. Since a speed of the main airflow, as shown by arrows 157, at the main air outlet 140 is higher than the surrounding area, some air will be drawn along a direction of the main airflow shown by arrows 157, through auxiliary air inlet 180 forming the auxiliary air flow shown by arrows 159, and this will bring extra positive and negative ions that are emitted out of protruded area 113. This, in other words, increases a total amount of positive and negative ions emitted out of hair dryer 100 during operation.

The user moves power button 112 to the off position so that electrical current is blocked from conducting to heater 135, motor 128, first pair of ion emitters 160 and second pair of ion emitters 170, from the power supply through the power cord 151 to cease operation of hair dryer 100.

Figure 4:
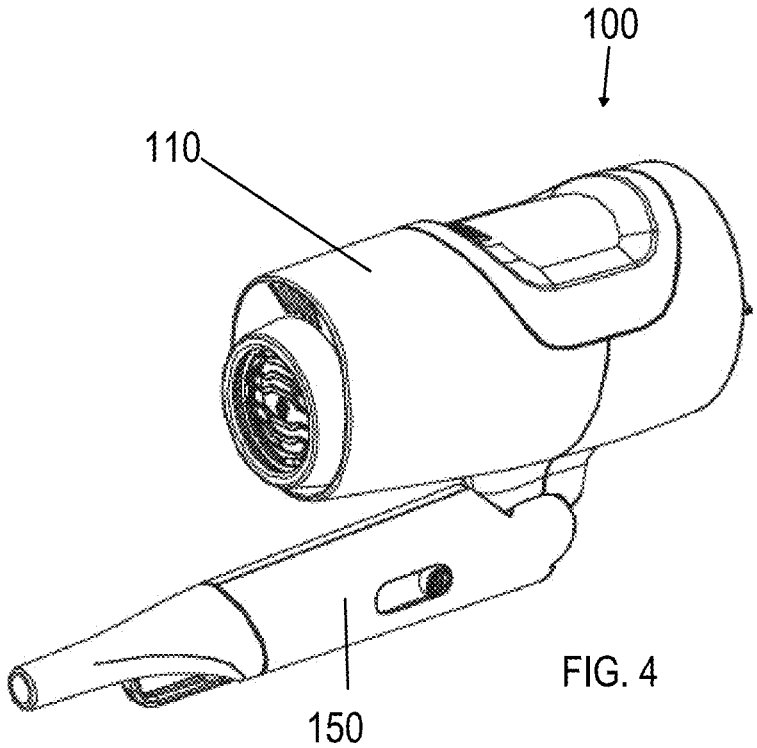
FIG. 4 is a top, front perspective view of the hair dryer of FIG. 1 in a folded position.
Figure 5:
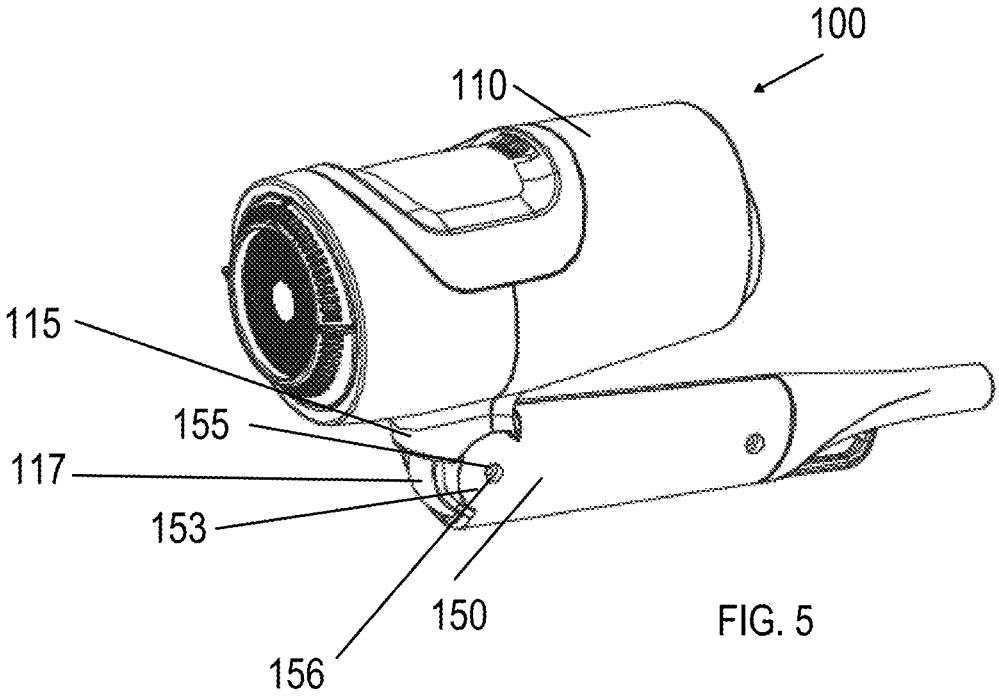
FIG. 5 is a top, rear view of the hair dryer of FIG. 1 in the folded position.
Figure 6:
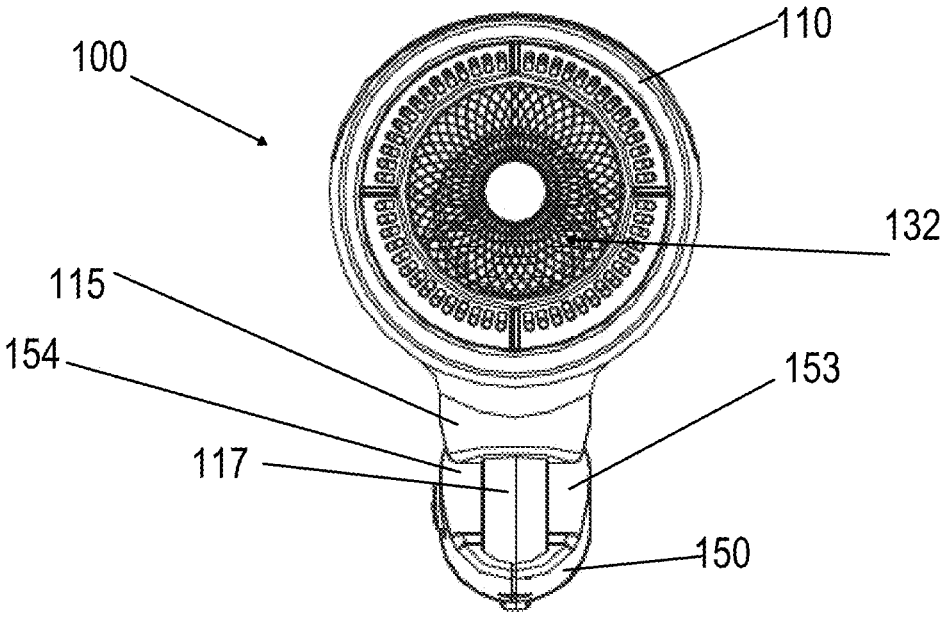
FIG. 6 is a rear view of the hair dryer of FIG. 1 in the folded position.

Referring to FIGS. 4-6, as noted above, handle 150 is foldable relative to housing 110. Referring to FIG. 6, connector portion 115 of housing 110 has an extended portion 117. Handle 150 has extension 153 on a first side of extended portion 117 and an extension 154 on a second side of extended portion 117 that is opposite the first side.

Referring to FIG. 5, pin 156 passes through opening 155 of extension 153 of handle 150 and through extended portion 117 of housing 110 so that housing 110 and handle 150 are rotatable relative to each other between an extended position, as shown in FIG. 1, and a folded position as shown in FIG. 4. Accordingly, when in the folded position, hair dryer 100 is compact for storage or transportation.

Advantageously, auxiliary air inlet 180 and auxiliary air outlet 190 are not in communication with main air inlet 130 and main air outlet 140 of hair dryer 100. Yet, hair dryer 100 still provides all the benefits of discharging positive and negative ions from second pair of ion emitters 170 while drying the user's hair.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

The invention claimed is:

1. A hair dryer comprising:

a housing having a main air inlet, a main air outlet and a main interior volume between the main air inlet and the main air outlet, the housing having an auxiliary air inlet, an auxiliary air outlet, and an auxiliary interior volume between the auxiliary air inlet and the auxiliary air outlet, the auxiliary air inlet, the auxiliary air outlet and the auxiliary interior volume each being outside of the main interior volume so that the auxiliary air inlet and the auxiliary air outlet are not in communication with the main air inlet and the main air outlet and air enters the auxillary air inlet from outside of the housing, the housing having a top portion opposite a bottom portion;

a handle extending from the bottom portion of the housing;

a first pair of ion emitters being located in the main interior volume between the main air inlet and the main air inlet;

a second pair of ion emitters being located in the auxiliary interior volume;

a fan in the main interior volume that selectively generates a main airflow through the housing from the main air inlet to the main air outlet, the fan being upstream of the first pair of ion emitters relative to the main airflow; and a heater in the main interior downstream of the fan and upstream of the main air outlet relative to the main airflow, wherein the auxillary air inlet and the auxillary air outlet each are positioned only on the top portion of the housing and the second pair of ion emitters are located on the top portion of the housing in the auxillary interior volume between the auxillary air inlet and the auxillary air outlet.

2. The hair dryer of claim 1, wherein the housing has an interior wall and an exterior wall, and wherein the interior wall surrounds the main interior volume.

3. The hair dryer of claim 2, wherein the auxiliary interior volume is between the exterior wall and the interior wall so that the interior wall separates the auxiliary interior volume from the main interior volume.

4. The hair dryer of claim 3, wherein the interior wall forms the main air inlet and the main air outlet.

5. The hair dryer of claim 4, wherein the exterior wall has an inlet hole forming the auxiliary air inlet.

6. The hair dryer of claim 5, wherein the exterior wall has an outlet hole forming the auxiliary air outlet.

7. The hair dryer of claim 6, wherein the interior wall and the exterior wall contact each other adjacent the auxiliary air outlet and the interior wall and the exterior wall contact each other adjacent the main air inlet to form the auxiliary interior volume.

8. The hair dryer of claim 6, wherein the auxiliary interior volume allows air to pass through the auxiliary air inlet forming an auxiliary air flow that passes through the auxiliary interior volume passing out of the auxiliary air outlet bringing positive and negative ions from the second pair of ion emitters out of the auxiliary air outlet.

9. The hair dryer of claim 8, wherein the main airflow has a speed at the main air outlet that is higher than a surrounding area so that some air will be drawn along a direction of the main airflow through the auxiliary air inlet to form the auxiliary air flow and this will bring the positive and negative ions that are emitted out the auxiliary interior volume.

10. The hair dryer of claim 1, wherein the first pair of ion emitters has a positive ion emitter that generates positive ions and a negative ion emitter that generates negative ions.

11. The hair dryer of claim 1, wherein the second pair of ion emitters has a positive ion emitter that generates positive ions and a negative ion emitter that generates negative ions.

12. The hair dryer of claim 1, wherein the main airflow brings positive and negative ions from the first pair of ion emitters out of the main air outlet.

13. The hair dryer of claim 1, wherein the housing has a main barrel and a connection portion that is connected to a handle.

14. The hair dryer of claim 13, wherein the handle is foldable relative to the housing.

15. The hair dryer of claim 14, wherein the handle has a handle body forming an extension on one end, and wherein the handle body has an opening through the extension to connect the handle to the housing by a hinge connection having a pin that passes through the opening of the handle and through the connection portion of the housing so that the housing and the handle are rotatable relative to each other.

16. The hair dryer of claim 1, wherein the auxiliary air inlet is nonadjacent to the main air inlet.

17. The hair dryer of claim 1, wherein the auxiliary air inlet is through a middle of the top portion of the housing.

* * * * *